US006896410B2

(12) United States Patent
Carter et al.

(10) Patent No.: US 6,896,410 B2
(45) Date of Patent: May 24, 2005

(54) REFUSE DISPOSAL IN SEVERE ENVIRONMENTS

(75) Inventors: H. Landis Carter, Greer, SC (US); Shobha Murari, Greenville, SC (US)

(73) Assignee: JPS Converter and Industrial Corporation, Slater, SC (US)

( * ) Notice: Subject to any disclaimer, the term of this patent is extended or adjusted under 35 U.S.C. 154(b) by 236 days.

(21) Appl. No.: 10/373,434

(22) Filed: Feb. 24, 2003

(65) Prior Publication Data

US 2003/0160050 A1 Aug. 28, 2003

Related U.S. Application Data

(60) Provisional application No. 60/359,978, filed on Feb. 27, 2002.

(51) Int. Cl.[7] ..... B65D 30/04

(52) U.S. Cl. ..... 383/117; 383/1; 383/100; 383/106; 383/107; 220/4.01; 220/4.04; 220/9.1; 220/908; 428/34.1; 428/34.3; 428/34.4; 428/34.5; 428/34.7; 428/36.1; 442/85; 442/123; 442/124; 442/131

(58) Field of Search ..... 220/4.01, 4.04, 220/908, 9.1; 383/1, 100, 106, 107, 117; 428/34.1, 34.3, 34.4, 34.5, 34.7, 36.1; 442/1, 43, 50, 58, 76, 85, 123, 124, 125, 126, 131, 286, 394

(56) References Cited

U.S. PATENT DOCUMENTS

| | | | | |
|---|---|---|---|---|
| 5,207,344 A | | 5/1993 | Davies et al. | 220/23.83 |
| 5,431,996 A | * | 7/1995 | Giesemann | 442/74 |
| 6,199,803 B1 | | 3/2001 | Schafer | 248/99 |

OTHER PUBLICATIONS

PCT International Preliminary Examination Report.

* cited by examiner

*Primary Examiner*—Arti R. Singh
(74) *Attorney, Agent, or Firm*—McNair Law Firm, P.A.

(57) ABSTRACT

Flexible and semi-rigid refuse containers are provided for long term storage of refuse in environments where perma-frost conditions prevail. The preferred containers are formed from woven fiberglass coated with a UV resistant polymer such as PVC.

16 Claims, 2 Drawing Sheets

REFUSE DISPOSAL IN SEVERE ENVIRONMENTS

CROSS REFERENCE TO RELATED APPLICATION

This application claims priority from Provisional Application Ser. No. 60/359,978, filed Feb. 27, 2002 by the applicants herein.

FIELD OF THE INVENTION

The present invention relates to methods and products for disposing of refuse in environments where the only practical means of disposing of the refuse is to safely and permanently package and store it at remote sites. In particular, the invention relates to disposing of refuse in regions where permafrost conditions prevail.

BACKGROUND OF THE INVENTION

Until recent years, the traditional way of disposing of refuse, trash, and waste materials was to transport it to a remote area and simply dump it. However, with the environmental concerns brought about by the problems created by the uncontrolled and unplanned dumping of raw waste, it has become the practice in most industrialized nations to segregate waste, recycle the recyclable materials, incinerate what can safely be burned, chemically treat and convert those waste products which can be so treated and converted, and dispose of the remaining products in carefully prepared landfills. However, in regions that are subjected to severe climates such as in the Artic and Antarctic regions where land is in a permafrost state, disposal of trash and refuse present unusual problems. These problems are magnified in these remote areas where chemical treatments, incineration, recycling, and landfills are simply precluded because of economic considerations. This is particularly true in those regions such as parts of Alaska where there is no significant urbanization nor infrastructure which provides all of the necessary means for waste disposal. In the recent past, in remote villages, it has been the practice to collect non-food and non-toxic waste in plastic bags and simply transport it to satisfactory distance from the village and leave it on the tundra. Since the permafrost condition prevents any landfills, and even if a landfill were possible, it would not be feasible to have sophisticated equipment to prepare refuse for landfills. However, one of the drawbacks to the present practice is that the plastic trash bags or disposal bags, particularly bags of polyethylene or polypropylene, after a period of time exposed to sunlight and severe cold, tend to weaken and rupture under the high wind conditions that are prevalent in these regions; and, unfortunately, the refuse is scattered across the tundra.

Accordingly, it is one object of the present invention to provide products and methods for secure, long-term storage of refuse so that the refuse is not undesirably scattered.

Another object of the present invention is to provide a receptacle which will contain significant amounts of refuse and be resistant to deterioration and rupture due to sunlight and temperature extremes.

Still another object of the present invention is to provide a means of protecting the environment in regions with extreme climatic conditions by safely storing and containing refuse.

The foregoing and other objects are accomplished by the invention which is described hereinafter.

SUMMARY OF THE INVENTION

In one aspect, the present invention is a method for containing refuse for an extended period of time in flexible or semi-rigid receptacles which are relatively easy to fill, close, transport, and store. Surprisingly, such a receptacle can be formed from a unique combination of woven mineral fiber mesh coated with a weather resistant polymer.

In another aspect, the invention is a receptacle comprising fabric panels of mineral fibers, particularly, glass, quartz or carbon fibers having walls which resist extreme temperatures, sunlight, moisture, rot, and degradation and which do not readily disintegrate nor degrade.

In yet another aspect, the present invention is a receptacle formed from walls or panels of woven glass fiber material coated with a moisture proofing material which resists UV deterioration.

In a still further aspect, the present invention is a unique receptacle, which combines the attributes of woven glass fiber mesh with a coating of vinyl chloride copolymer that is treated with anti-microbial agents and with agents that repel or deter rodents or other animals from gnawing or chewing the receptacles. The coating may also be of an acrylic/vinyl chloride copolymer or other weather resistant polymer.

The invention will be better understood by reference to the accompanying drawings and the detailed description which follows.

BRIEF DESCRIPTION OF THE DRAWINGS

The drawings attached hereto and made a part of this disclosure are by way of illustration and are not a limitation on the scope of the invention. In the drawings.

DETAILED DESCRIPTION

By way of illustration an Artic region having permafrost is used in the description that follows. This region could be in Alaska, Canada, Siberia, or Greenland. However, the invention is also applicable in Antarctica or in those regions such as rain forests or the tropics where, again, disposal of refuse is not possible in the same manner as in highly urbanized regions with waste treatment facilities and land fills. Safe, environmentally friendly, and long term above ground containment and storage is the only practical means of waste disposal.

Using Alaska as an illustration but not as a limiting situation, typically in a small village, each villager would place his or her refuse, which is not a food waste nor a toxic chemical into a container, or receptacle. Preferably, such a receptacle is cube-like and can be formed of six panels to form a cube so that when packed and stuffed the cubes can be positioned together in a compact array. Stacking is possible in this manner. The upper panel of the cube is the fill panel and may be sewn or secured on one edge leaving the three sides unsealed to serve as the fill flap. The fill flap may be provided with snaps, a zipper or Velcro® closure for the unsealed edges or it may be sewn or stitched closed by the user. Secure mechanical closure such as sewing is desirable as adhesive tends to weaken under both high and low temperature extremes.

The filled bags or receptacles are collected on a periodic basis and moved to the remote location on the tundra where they remain indefinitely. They can be stacked in neat arrays, and a tan color for the material of the receptacles is preferred which blends with the summer landscape, as during the winter the receptacles will generally be covered with varying depths of snow.

Figure 1:
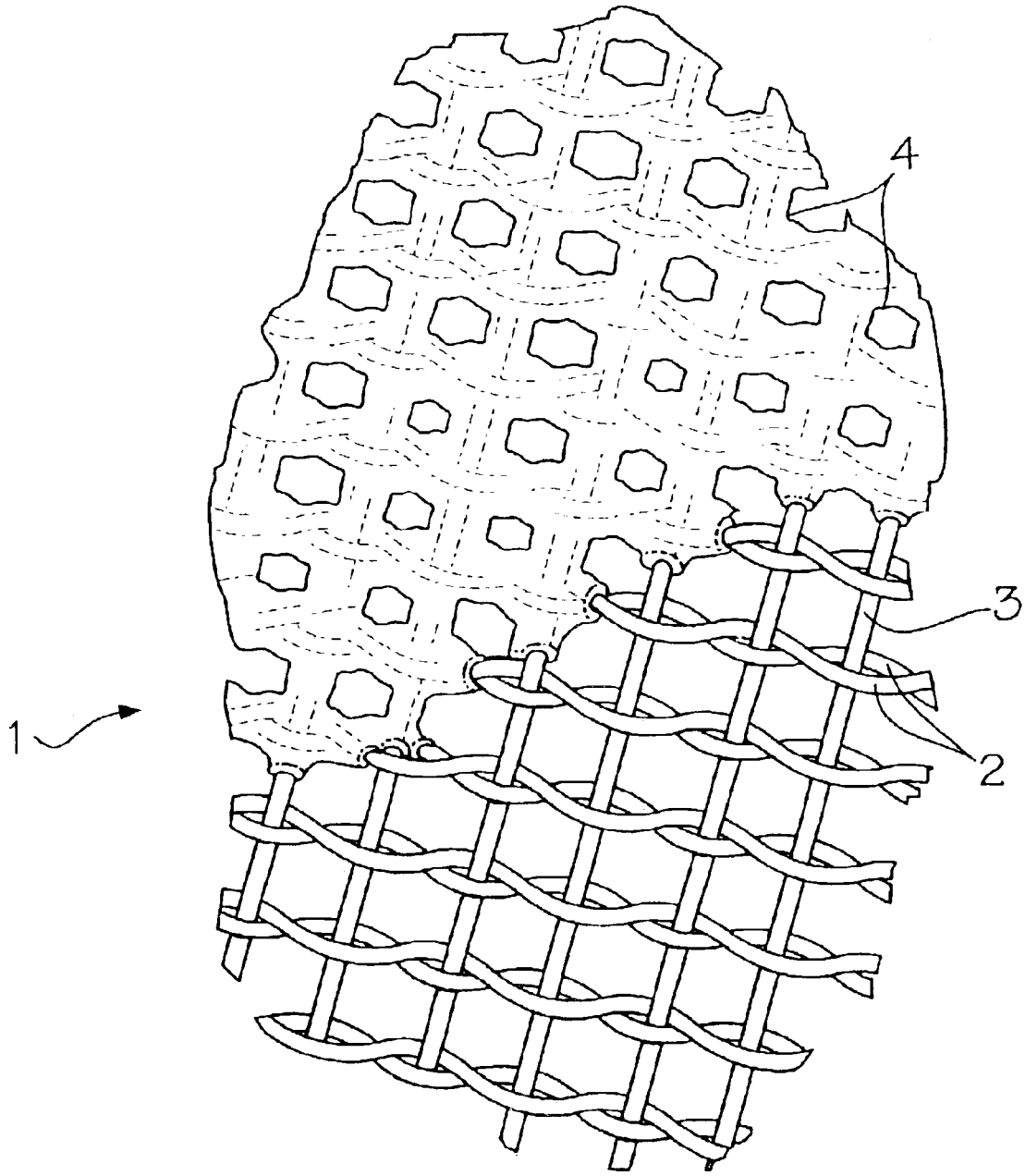
FIG. 1 is an enlarged perspective of a preferred weave for the coated fabric from which the receptacles of the present invention are made.

Turning now to FIG. 1 a preferred embodiment will be described. The preferred type of mesh 1 woven from glass fiber yarn is shown. This weave is known as a leno weave which can be produced with relatively few strands of yarns. The weave locks the yarns in place by crossing two or more warp threads 2 over each other and interlacing them with one or more fill threads 3. This provides a dimensionally stable weave. A fabric woven in this fashion is then preferably coated with vinyl chloride copolymer, which can be applied by either dipping the fabric in a polyvinyl chloride polymer bath or by coating the polymer on to the fabric with rollers, or a spray, or by extensive coating of a molten polymer. The vinyl chloride coating 4 may have openings therein as shown where the lead lines 4 are directed to the PVC coating. These openings may be random or may be large or small depending on the coating thickness. The shadow lines show the weave pattern continuing within and under the coating.

The coating 4 tends to stabilize and shape the structure and protect the fibers from abrasion. Vinyl chloride copolymer (PVC) is preferred because of its resistance to ultraviolet ray deterioration and ready availability and formability. Following the coating with PVC the fabric may be coated or treated with anti-microbial and anti-mildew agents, which are well known in the art. The material can also be subjected to additional treatment with an agent to repel animals that gnaw or chew such as rats, beavers, raccoons, moose, and the like.

Non-woven fabrics may also be employed and not only can be formed from glass fibers but also from blends of glass, quartz, or other mineral fibers or from carbon fibers.

Following the preparation of the fabric with the coating and the treatment with the anti-microbial, anti-mildew and animal repellant agents, the fabric is then cut into panels to form bags or receptacles. While the six panel cube shape described above is one preferred embodiment, the two panel lay flat bag is also another. In the lay flat bags, one panel is superposed above another and three of the adjacent edges are sewn together leaving the fourth edge unsewn as the filling opening for the bag.

Figure 2:
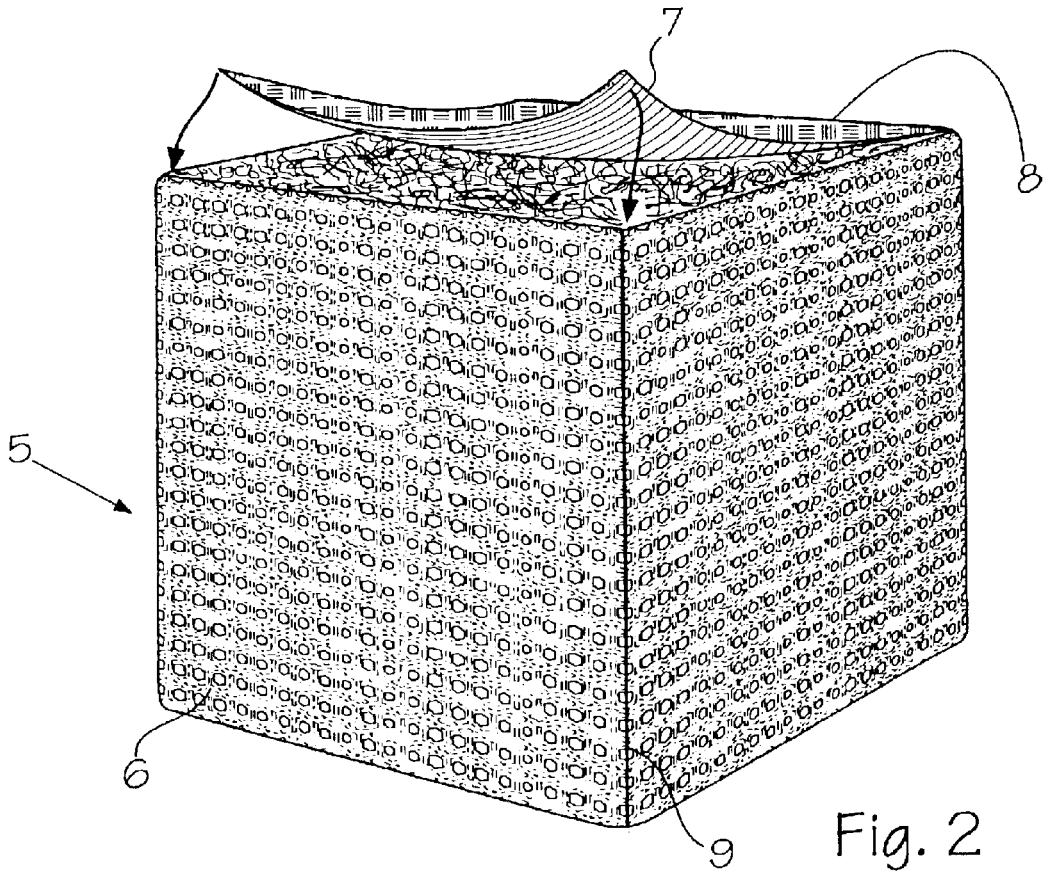
FIG. 2 is a representation of preferred receptacle made from the fabric of FIG. 1 prior to closure of the receptacle.

In the particularly preferred cubed arrangement, a container 5 as represented in FIG. 2 is prepared. Two square 4 ft. by 4 ft. panels are prepared as the side panel, and then a separate sheet is prepared, which is the length of four of the side panels so that is 4 ft. by 16 ft. This sheets begins with front 6, forms the bottom, back, and top panels 7. The side panels are sewn along seams 9 on the front, bottom, and back leaving the top panel as an open flap 7 to receive trash 8. For shipment ease, the precut panels and sheet can be shipped to remote towns and villages in lay flat stacks and at each village the panels can be sewn together to form receptacles.

The containers 5 in the preferred size described above will hold 64 cubic feet of trash. In order to facilitate the loading of trash 8 into the receptacle, the receptacle can be positioned on the bed of a pick up truck, a trailer, wagon, a similar vehicle with the top panel 7 rolled back. The bed is preferably equipped with a frame with hooks or clamps to secure each upper corner of a receptacle so the opening or mouth of the container remains open and collected trash may be readily tossed or dumped therein. When each container is filled and packed, it will stand alone so any supporting members or hooks or clamps may be removed and the top panel 7 closed. It is preferred that the panel be sewn with stitches to securely close it around the three open sides. When so closed the container 5 is ready for storage.

Figure 3:
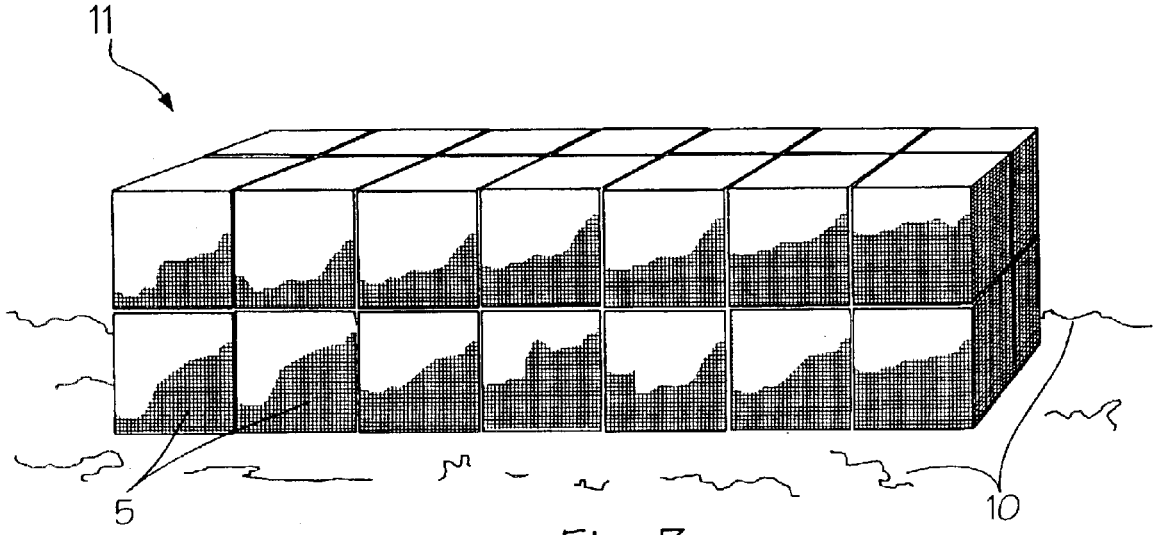
FIG. 3 shows a stack of filled containers placed in a remote location.

In FIG. 3 a stacked array 11 of the closed cubed containers 5 is shown at a remote location 10 on the tundra. The cubed containers allow for the most compact and stable array to withstand the weather and destruction by animals.

As an alternative to the cubical shape, the two-panel receptacle mentioned above can be employed and it resembles a pillow when filled. These "pillow packs" can be stacked on top of each other like sacks of fertilizer or stacked edgewise. However, cubical or rectangular containers are preferred as they provide greater volume per unit of surface area thus reducing the quantity of fabric needed to store a given volume of trash. Generally, sufficient rigidity will be provided by the cubical container when packed tightly with trash but an interior, "tent-like" frame of PVC tubing can be provided for larger volume containers than the 64 cubic foot container.

Within the scope of the invention, alternate fibers other than fiberglass, which are inert and resistant to long-term deterioration, may be used. Among these fibers are materials such as quartz and carbon fibers. In general, inorganic mineral fibers would be suitable. These materials are also desirable because they tend to be flame retardant.

The presence of the polymeric coating also provides a degree of moisture resistance to the receptacles made from the fabric of the inventor and can further act as a carrier for the anti-mildew and anti-climatic microbial agents and for the animal repellants. In addition, the polymeric coating provides a measure of stiffness so the fabric can be readily shaped into a receptacle. Other polymers than vinyl chloride copolymers can be used but some of them may require the addition of UV damage retardants so that they do not breakdown over long periods of time.

The preferred embodiment of the fabric of the invention, as stated previously, is one having the fabric woven in a leno weave and coated with vinyl chloride copolymer or acrylic/vinyl chloride copolymer. Vinyl chloride copolymers or PVC are widely known and are readily used by those skilled in the art. The receptacles formed from panels of this fabric can be either sewn at the edges or heat welded along the three edges of side panel in the cubical shape. Receptacles of lay flat bags, single fold or two separate panels, gusseted bags, cubes, and rectangular parallelepiped can also be formed. Also, panels of differing materials could be used. For example, a rigid PVC sheet could serve as a "floor" or bottom panel. Furthermore, a receptacle of a single, folded panel can readily be constructed. Such a container would be a centerfold container with the "bottom" of the bag or container being the centerfold. The side edges could be sewn, or if a heat sealable polymer is used as the coating material, the edges could be joined by heat sealing. The receptacle material can be made of relatively heavy gauge fabric and coating for forming a semi-rigid receptacle or a lighter gauge material can be woven and lightly coated for a flexible receptacle such as a bag. Such bags can be lay-flat or gusseted and provided with drawstring or twist-tie closures.

Because many varying and different embodiments may be made within the scope of the inventive concepts taught herein and because many modifications may be made in the embodiments herein detailed in accordance with the descriptive requirements of the law, it is to be understood that the details herein are to be interpreted as illustrative and not in a limiting sense, the invention being limited only by the scope of the claims appended hereto.

We claim:

1. A refuse receptacle for a severe environment comprising:

a) at least one panel of mineral fiber fabric, said fabric being coated with a UV resistant, polymeric material; and b) said panel being joined along its respective edges to itself or another panel leaving at least a portion of one edge open to serve as a filling opening for the receptacle.

2. The receptacle of claim 1 wherein the mineral fiber is selected from the group consisting of glass fiber or quartz fiber.

3. The receptacle of claim 1 wherein the UV resistant polymeric material is a polymeric material with UV damage retardants incorporated therein.

4. The receptacle of claim 1 wherein the polymeric material is a vinyl chloride copolymer.

5. The receptacle of claim 1 wherein the fabric is a woven fabric.

6. A method of disposing of and containing refuse in a severe environment comprising the steps of:

a) forming a receptacle having an opening and at least one wall panel of mineral based fabric, said fabric being coated with a material having UV resistance and providing moisture repellency to the receptacle;

b) filling the receptacle with refuse and securely closing same; and c) storing said filled receptacles in a remote location.

7. The method of claim 6 wherein the mineral based fiber is fiberglass and the coating material is vinyl chloride copolymer.

8. The method of claim 6 wherein the receptacle is cubical in shape.

9. The method of claim 6 wherein the receptacle is formed from one folded panel joined to itself along its respective edges.

10. The method of claim 6 wherein the said coated fabric is a semi-rigid fabric and the receptacle is a multi-panel receptacle.

11. The method of claim 6 wherein said coated fabric is flexible and a bag-like container is formed.

12. The method of claim 6 wherein the remote location is on the Artic, permafrost tundra.

13. A refuse receptacle for a severe environment comprising:

a) six rectangular panels of a coated fabric, said fabric being a woven fabric of fiberglass coated with a vinyl chloride copolymer;

b) said panels being joined along respective sides to form a rectangular parallelepiped container.

14. The refuse receptacle of claim 13 wherein the six panels are square and the receptacle is a cube.

15. The receptacle of claim 14 wherein four of the six panels are formed from two square panels and a continuous length of said fabric being the length of four sides of said square panels and the width of one square panel, to form the front, bottom, back and top panels, and said side panels being joined at respective edges to corresponding edges of said continuous length to form a cubical receptacle.

16. The receptacle of claim 15 wherein the receptacle is filled with trash.

* * * * *